US007451787B2

(12) United States Patent
Speich

(10) Patent No.: US 7,451,787 B2
(45) Date of Patent: Nov. 18, 2008

(54) WEFT INTRODUCTION NEEDLE FOR A RIBBON NEEDLE LOOM

(75) Inventor: Francisco Speich, Gipf-Oberfrick (CH)

(73) Assignee: Textilma AG (CH)

( * ) Notice: Subject to any disclaimer, the term of this patent is extended or adjusted under 35 U.S.C. 154(b) by 36 days.

(21) Appl. No.: 11/597,849

(22) PCT Filed: Jun. 3, 2004

(86) PCT No.: PCT/CH2004/000338

§ 371 (c)(1),
(2), (4) Date: Nov. 28, 2006

(87) PCT Pub. No.: WO2005/118930

PCT Pub. Date: Dec. 15, 2005

(65) Prior Publication Data

US 2007/0227612 A1 Oct. 4, 2007

(51) Int. Cl.

| | |
|---|---|
| ***D03D 35/00*** | (2006.01) |
| ***D03D 47/42*** | (2006.01) |
| ***D03D 47/10*** | (2006.01) |
| *D03D 47/20* | (2006.01) |

(52) U.S. Cl. ..... 139/22; 139/23; 139/51; 139/53; 139/448; 139/281

(58) Field of Classification Search ..... 139/22, 139/23, 48, 49, 50, 51, 53, 431, 454, 449, 139/448, 447, 441, 442, 170.3, 199, 201, 139/269, 278, 281, 287

See application file for complete search history.

(56) References Cited

U.S. PATENT DOCUMENTS 639,018 A * 12/1899 Brun ..... 139/440

(Continued)

FOREIGN PATENT DOCUMENTS

EP 0 121 648 A1 10/1984

(Continued)

OTHER PUBLICATIONS http://www.google.com/search?hl=en&rls=GGLH, GGLH:1969-53,GGLH:en&defl=en&q=define:bow&sa=X&oi=glossary_definition&ct=title, Define "bow".*

*Primary Examiner*—Bobby H Muromoto, Jr.
(74) *Attorney, Agent, or Firm*—George Pappas

(57) ABSTRACT

The weft introduction needle for a ribbon needle loom comprises a bent arm (20), which may be fixed at one end (22) to a drive element (24) of a ribbon needle loom and comprises a hook (28) at the other end (26), for registering an exposed thread loop. The arm (20) is provided with a guide piece (30) essentially over the whole length thereof, forming a longitudinal slot (32) with the arm (20) for accommodating at least one weft thread. At the end away from the hook (28), the guide piece is connected to the arm (20), by means of a connector piece (34). A guidance element (36) is arranged on the side of the arm (20) facing away from the guide piece (30) in order to improve the guiding of a weft thread loop, extending over only a section of the length of the arm, starting from the vicinity of the hook (28), whereby the guidance element (36) forms a diverter point (35) in the region away from the hook (28), for diverting the free flare (38) of the weft thread loop (6).

11 Claims, 2 Drawing Sheets

U.S. PATENT DOCUMENTS 1,405,274 A * 1/1922 Campbell et al. ..... 139/117
1,869,062 A * 7/1932 Klahre ..... 139/199
2,095,480 A * 10/1937 Schlegel ..... 139/433
2,112,912 A * 4/1938 Kennary ..... 139/433
2,130,636 A * 9/1938 Clutsom ..... 139/431
2,192,728 A * 3/1940 Dewas ..... 139/448
2,208,886 A * 7/1940 Vorck ..... 139/442
2,229,011 A * 1/1941 Clutsom ..... 139/431
2,258,538 A * 10/1941 Clutsom ..... 139/431
2,416,098 A * 2/1947 Holt ..... 139/22
2,470,981 A * 5/1949 Hardick ..... 139/199
2,515,653 A * 7/1950 Johnson ..... 139/199
2,625,959 A * 1/1953 Turner ..... 139/431
2,757,692 A * 8/1956 Ferdinando ..... 139/433
2,758,614 A * 8/1956 Silberman et al. ..... 139/432
2,782,808 A * 2/1957 Laferte ..... 139/270
2,902,057 A * 9/1959 Turner ..... 139/442
3,457,965 A * 7/1969 Burbank ..... 139/11
3,519,029 A * 7/1970 Piazzola et al. ..... 139/431
3,601,160 A * 8/1971 Chetty ..... 139/431
3,682,205 A * 8/1972 Scott ..... 139/431
3,752,195 A * 8/1973 Libby ..... 139/431
3,901,285 A * 8/1975 Griffith ..... 139/441
4,006,758 A * 2/1977 Libby ..... 139/116.1
4,027,703 A * 6/1977 Diesner ..... 139/431
4,181,159 A * 1/1980 Frohlich et al. ..... 139/116.1
4,298,033 A * 11/1981 Takahashi et al. ..... 139/450
4,305,434 A * 12/1981 Muller ..... 139/431
4,331,181 A * 5/1982 Murasaki ..... 139/431
4,344,463 A * 8/1982 Muller et al. ..... 139/383 R
4,390,046 A * 6/1983 Shimono ..... 139/442
4,421,142 A * 12/1983 Muller ..... 139/117
4,440,197 A * 4/1984 Masuda ..... 139/431
4,541,461 A * 9/1985 Villa ..... 139/442
4,577,665 A * 3/1986 Diesner ..... 139/431
4,640,317 A * 2/1987 Chardon et al. ..... 139/431
4,688,598 A * 8/1987 Klos ..... 139/383 R
4,733,700 A * 3/1988 Griffith ..... 139/383 R
5,127,443 A * 7/1992 Ducamp et al. ..... 139/22
5,141,031 A * 8/1992 Baurmeister ..... 139/383 R
5,224,522 A * 7/1993 Baurmeister ..... 139/431
5,251,677 A * 10/1993 Riesen ..... 139/439
5,299,603 A * 4/1994 Reiter ..... 139/431
5,411,064 A * 5/1995 Yamagishi ..... 139/449
5,564,477 A * 10/1996 Probst ..... 139/442
5,878,787 A * 3/1999 Speich ..... 139/22
5,947,161 A * 9/1999 Speich ..... 139/22
5,954,098 A * 9/1999 Speich ..... 139/431
6,112,775 A * 9/2000 Hossli et al. ..... 139/383 R
2007/0089799 A1 * 4/2007 Zorini ..... 139/22

FOREIGN PATENT DOCUMENTS

GB 2 146 665 A 4/1985

* cited by examiner

WEFT INTRODUCTION NEEDLE FOR A RIBBON NEEDLE LOOM

This application claims priority of PCT application PCT/CH2004/000338 having a priority date of Jun. 3, 2004, the disclosure of which is incorporated herein, by reference.

FIELD OF THE INVENTION

The invention relates to a weft introduction needle for a ribbon needle loom.

BACKGROUND OF THE INVENTION

A weft introduction needle is known from CH 663 629 A. When the weft introduction needle is used on a ribbon needle loom in which a weft loop introduced into a shed is to be tied off by means of an auxiliary thread on the side facing away from the introduction side, disadvantages arise in that the two limbs of the weft loop enter the effective range of the knitting needle, thus making it more difficult to tie off satisfactorily in a very confined space.

SUMMARY OF THE INVENTION

The object of the invention is to improve further the weft introduction needle in order to avoid said disadvantages.

A guide element is arranged on the arm, on a side facing away from the guide bow, which extends, starting from the region of the hook, over only a portion of the length of the arm. The guide element forms, on the region facing away from the hook, a deflection point for deflecting the free limb of the weft loop. The free limb of the introduced weft loop is thereby deflected, so that it does not enter the effective range of the knitting needle, thus ensuring a satisfactory tie-off of the weft loop by means of an auxiliary thread, this being achieved in a very confined space.

Advantageous developments of the weft introduction needle are specified herein.

The guide element may be designed as a second guide bow which is arranged on that side of the arm facing away from the first guide bow and which, engaging over the hook, extends, starting from the front end of the weft introduction needle, over only a portion of the length of the arm and is connected to the latter, the connection point on the arm forming a deflection point for deflecting the free limb of the weft loop.

A particularly simple solution is described, according to which the guide element is designed as a guide groove which, starting from the hook, extends over the portion of the length of the arm on the outside of the arm, the curvature of the arm forming the deflection point.

Depending on the structural conditions of the ribbon needle loom, it may be advantageous to cause the guide element to extend over only the first third or the first quarter of the length of the arm.

It is basically possible to arrange the first guide bow at the top and the guide element at the bottom, but a configuration of the weft introduction needle is substantially more advantageous, according to which the first guide bow is arranged at the bottom and the guide element at the top.

There are also various configuration possibilities for the design of the hook. The design is preferred, however, according to which the hook points toward the outside of the bent arm.

BRIEF DESCRIPTION OF THE DRAWINGS

Exemplary embodiments of the invention are described in more detail below with reference to the drawings in which.

DETAILED DESCRIPTION OF THE INVENTION

Figure 1:
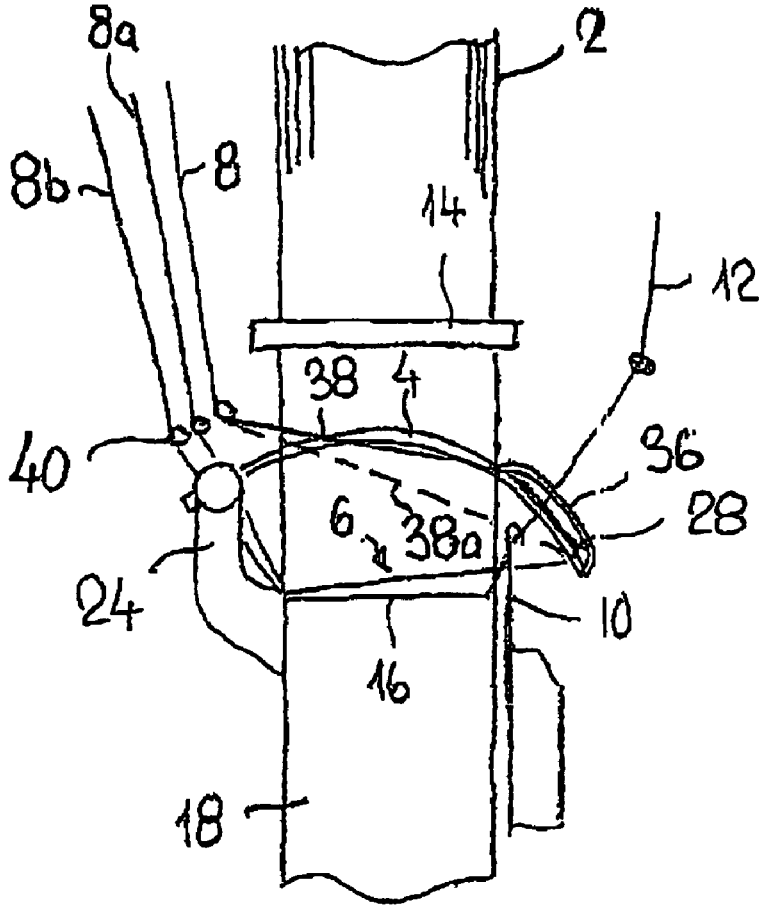
FIG. 1 shows the weaving region of a ribbon needle loom in a top view and in the form of a detail.

FIG. 1 shows the weaving region of a ribbon needle loom. Warp threads 2 are opened by means of a shedding device, not illustrated in any more detail, into a shed, into which a weft loop 6 of a laterally supplied weft thread 8 is introduced by means of a weft introduction needle 4. On the side facing away from the introduction side, there is a knitting needle 10 which knits an auxiliary thread 12 together with the weft loop 6 in order to secure the weft loop. The secured weft loop 6 is beaten up at the beating-up edge 16 by means of a reed 14 so that a ribbon fabric 18 is obtained.

Figure 2:
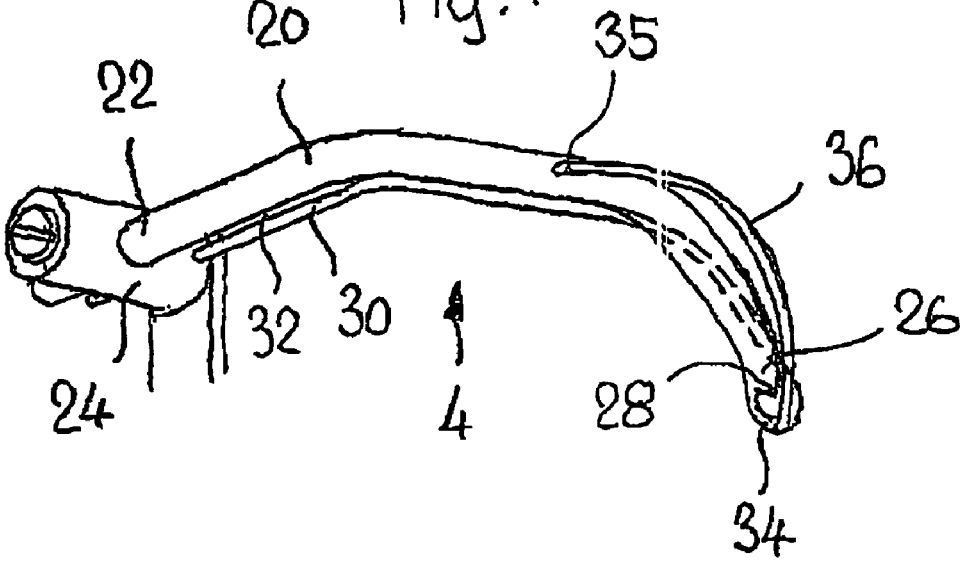
FIG. 2 shows a weft introduction needle for the ribbon needle loom of FIG. 1.

The weft introduction needle 4 is illustrated in more detail in FIG. 2. The weft introduction needle 4 has a bent arm 20 which is connected at one end 22 to a drive element 24 of the ribbon needle loom. A hook 28 for picking up the weft loop 6 is arranged at the other end 26. The arm 20 has, essentially over its entire length, a lower, first guide bow 30 which with the arm forms a slot 32 for receiving at least one weft thread 8. At the end facing the hook 28, the guide bow 30 is firmly connected to the arm 20 via a connection part 34. Arranged on the side facing away from the first guide bow 30 is a guide element in the form of a second guide bow 36 which engages over the hook 28 and which, on the one hand, is fastened to the front end of the weft introduction needle, preferably to the connection part 34 of the first guide bow 30, and, on the other hand, extends over only a portion, for example one quarter to one third, of the length of the arm 20 and is fastened to the latter. This fastening forms a deflection point 35 for deflecting the free limb 38 of the weft loop 6. The length of the second guide bow is to be selected such that the free limb of the weft loop does not enter the effective range of the knitting needle.

As can be seen particularly from FIG. 1, the second guide bow 36 steers the free limb 38 of the weft loop 6 out of the effective range of the knitting needle 10, so that the free limb 38 is not picked up when the auxiliary thread 12 is being knitted in. If the second guide bow 36 were absent, the free limb of the weft loop 8 would follow the path 38*a* indicated by dashes and consequently enter the effective range of the knitting needle 10, with the result that it would at least be more difficult to tie off the weft loop 6 reliably by means of the auxiliary thread 12. FIG. 1 indicates that a plurality of weft threads 8, 8*a*, 8*b* may be supplied via the guide member 40, which lie in the slot 32 of the first guide bow 30 and can be brought into engagement selectively with the hook 28 of the weft introduction needle in a way not illustrated in any more detail, as is known from the prior art.

Figure 4:
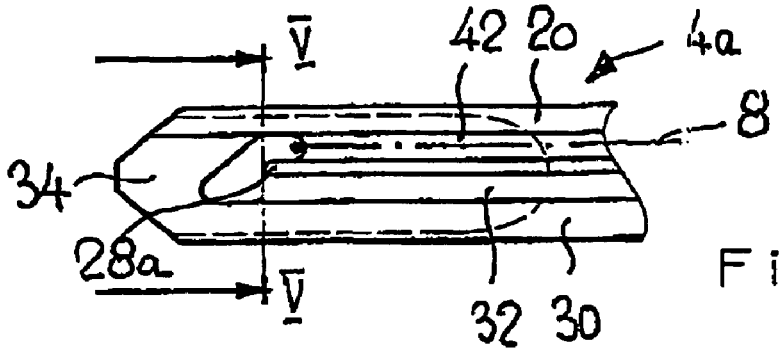
FIG. 4 shows the weft introduction needle of FIG. 3 in a view of the head part according to IV of FIG. 3.
Figure 3:
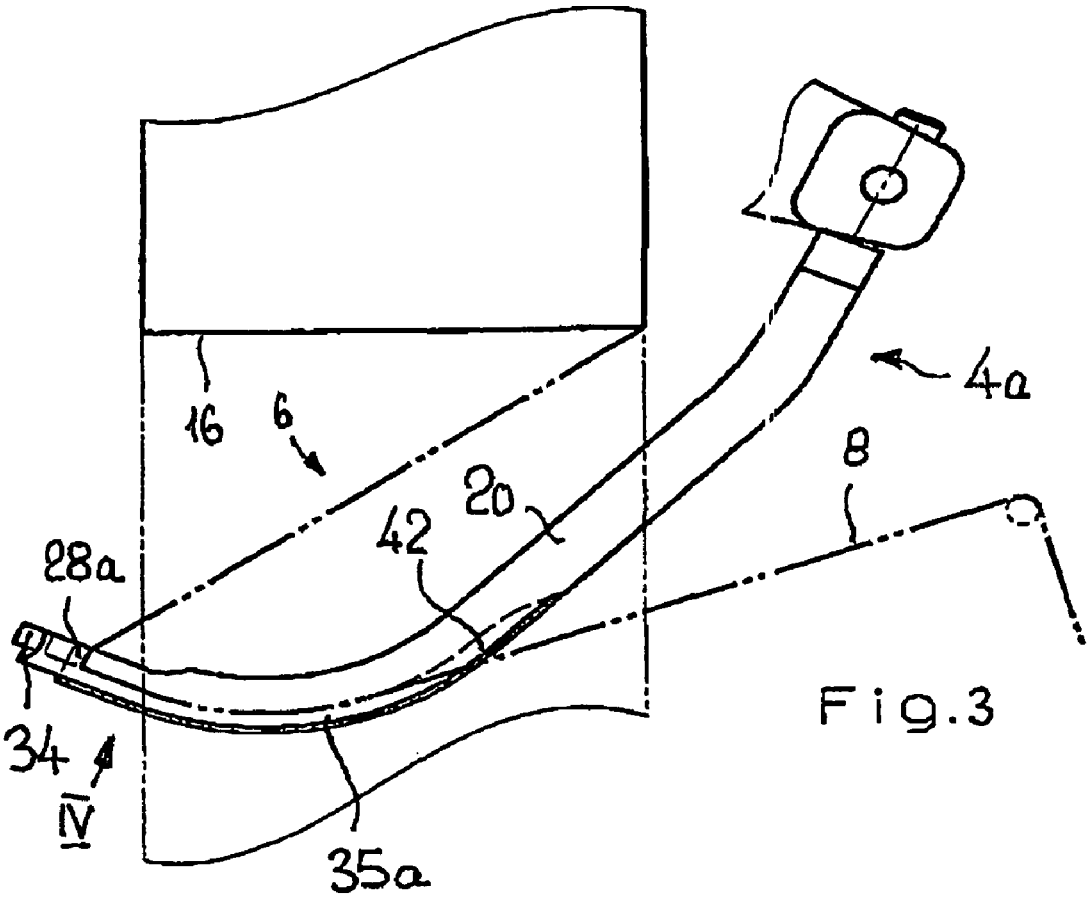
FIG. 3 shows the weaving region of a ribbon needle loom with a modified weft introduction needle in a top view and in the form of a detail.
Figure 5:
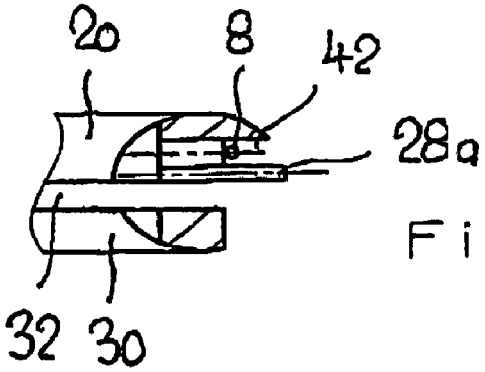
FIG. 5 shows the weft introduction needle in the section V-V of FIG. 4.

FIGS. 3 to 5 illustrate a further exemplary embodiment of a weft introduction needle 4*a* which corresponds to that of FIGS. 1 and 2, and therefore identical parts are given the same reference symbols. In the weft introduction needle of FIGS. 3 to 5, the guide element is designed as a guide groove 42 which, starting from the hook 28*a*, runs over a portion of the length of the arm 20, specifically on its outside which to that extent faces away from the guide bow 30. The selected weft thread 8 is lifted in the region of the connection part 34 out of the lower slot 32 into the upper region of the hook 28*a* and thus enters the hook 28*a*. When the weft introduction needle 4*a* swings into the shed, the weft thread 8 is guided in the guide groove 42, the curvature of the arm 20 forming the deflection point 35*a* which deflects the weft limb to an extent such that it does not enter the effective range of the knitting needle, not illustrated in any more detail here.

LIST OF REFERENCE SYMBOLS

2 Warp thread
4 Weft introduction needle
4*a* Weft introduction needle
6 Weft loop
8 Weft thread
8*a* Weft thread
8*b* Weft thread
10 Knitting needle
12 Auxiliary thread
14 Reed
16 Beating-up edge
18 Ribbon fabric
20 Bent arm
22 End
24 Drive element
26 End
28 Hook
28*a* Hook
30 First guide bow
32 Slot
34 Connection part
35 Deflection point
35*a* Deflection point
36 Second guide bow
38 Limb
38*a* Path
40 Guide member
42 Guide groove

The invention claimed is:

1. A weft introduction needle for a ribbon needle loom, which has a bent arm which can be fastened at one end to a drive element of a ribbon needle loom and at the other end has a hook for picking up a weft loop, the arm being assigned, essentially over its entire length, a guide bow which with the arm forms a longitudinal slot for receiving at least one weft thread and which is connected at the end facing the hook to the arm via a connection part, wherein the arm has arranged on it, on a side facing away from the guide bow, a guide element which extends, starting from the region of the hook, over only a portion of the length of the arm, the guide element forming, on the region facing away from the hook, a deflection point for deflecting the free limb of the weft loop, outside the effective range of the knitting needle wherein the guide element is designed as a second guide bow spaced from the arm which is arranged on that side of the arm facing away from the first guide bow and which, extending over the hook, extends from a first connection point proximate the front end of the weft introduction needle, over only a portion of the length of the arm to a second connection point where said second guide bow is connected to the arm, the second connection point on the arm forming the deflection point.

2. A weft introduction needle for a ribbon needle loom, which has a bent arm which can be fastened at one end to a drive element of a ribbon needle loom and at the other end has a hook for picking up a weft loop, the arm being assigned, essentially over its entire length, a guide bow which with the arm forms a longitudinal slot for receiving at least one weft thread and which is connected at the end facing the hook to the arm via a connection part, wherein the arm has arranged on it, on a side facing away from the guide bow, a guide element which extends, starting from the region of the hook, over only a portion of the length of the arm, the guide element forming, on the region facing away from the hook, a deflection point for deflecting the free limb of the weft loop, outside the effective range of the knitting needle wherein the guide element is designed as a guide groove which, starting from the hook, extends over the portion of the length of the arm on the outside of the arm, the curvature of the arm forming the deflection point.

3. The weft introduction needle as claimed in claim 1, characterized in that the guide element extends over the first third to a quarter of the length of the arm.

4. The weft introduction needle as claimed in claim 1, characterized in that the first guide bow is arranged at the bottom and the guide element is arranged above the latter.

5. The weft introduction needle as claimed in claim 1, characterized in that the hook points toward the outside of the bent arm.

6. The weft introduction needle as claimed in claim 2, characterized in that the guide element extends over the first third to a quarter of the length of the arm.

7. The weft introduction needle as claimed in claim 2, characterized in that the first guide bow is arranged at the bottom and the guide element is arranged above the latter.

8. The weft introduction needle as claimed in claim 3, characterized in that the first guide bow is arranged at the bottom and the guide element is arranged above the latter.

9. The weft introduction needle as claimed in claim 2, characterized in that the hook points toward the outside of the bent arm.

10. The weft introduction needle as claimed in claim 3, characterized in that the hook points toward the outside of the bent arm.

11. The weft introduction needle as claimed in claim 4, characterized in that the hook points toward the outside of the bent arm.

* * * * *